US009068285B2

(12) United States Patent
Zorbach

(10) Patent No.: US 9,068,285 B2
(45) Date of Patent: Jun. 30, 2015

(54) KNITTING NEEDLE

(76) Inventor: Diane Zorbach, Frankfurt am Main (DE)

( * ) Notice: Subject to any disclaimer, the term of this patent is extended or adjusted under 35 U.S.C. 154(b) by 0 days.

(21) Appl. No.: 14/124,661

(22) PCT Filed: May 11, 2012

(86) PCT No.: PCT/EP2012/002047
§ 371 (c)(1),
(2), (4) Date: Dec. 6, 2013

(87) PCT Pub. No.: WO2012/167863
PCT Pub. Date: Dec. 13, 2012

(65) Prior Publication Data

US 2014/0202215 A1 Jul. 24, 2014

(30) Foreign Application Priority Data

Jun. 7, 2011 (DE) ..... 20 2011 102 677
Sep. 16, 2011 (DE) ..... 20 2011 105 722

(51) Int. Cl.
*D04B 3/02* (2006.01)

(52) U.S. Cl.
CPC ..... *D04B 3/02* (2013.01)

(58) Field of Classification Search
CPC ..... D04B 3/00; D04B 3/02; D04B 35/02
USPC ..... 66/116, 117, 118, 123, 1 A
See application file for complete search history.

(56) References Cited

U.S. PATENT DOCUMENTS 1,313,461 A * 8/1919 Brown ..... 66/117
1,620,550 A * 3/1927 Howe ..... 66/117
1,692,220 A * 11/1928 Osberg ..... 66/117
1,692,583 A * 11/1928 Shepperack ..... 66/117
1,704,790 A * 3/1929 Cook ..... 66/117
1,751,796 A * 3/1930 Denner ..... 223/102
1,765,303 A * 6/1930 Hoffman ..... 66/117
1,780,790 A * 11/1930 Leavin et al. ..... 66/117
1,989,352 A * 1/1935 Davis ..... 66/117
2,043,958 A * 6/1936 Engel ..... 66/117
2,045,267 A * 6/1936 Graham ..... 66/117
2,061,282 A * 11/1936 Leboff et al. ..... 66/117
2,093,631 A * 9/1937 Burnham ..... 66/117
2,094,262 A * 9/1937 Burnam ..... 66/117
2,230,495 A * 2/1941 Kohlmann ..... 66/117
2,274,572 A * 2/1942 Yates ..... 66/117
2,279,662 A * 4/1942 Denner ..... 223/102
2,404,855 A * 7/1946 Marshall ..... 66/117
2,414,353 A * 1/1947 Birmingham ..... 66/117
2,462,473 A * 2/1949 Delaney ..... 66/117

(Continued)

FOREIGN PATENT DOCUMENTS

TW 385347 B1 * 9/1997

*Primary Examiner* — Danny Worrell
(74) *Attorney, Agent, or Firm* — Jennifer S. Stachniak

(57) ABSTRACT

A knitting needle (200) for producing plait-patterns knitware includes a shaft-like portion (204), a first limb-like portion (206), which extends in a first direction of extent (A) and has an outwardly directed first free end (209) and a second limb-like portion (208), which extends in a second direction of extent (B) and has an outwardly directed second end (210). The two limb-like portions (206; 208) are connected rigidly to one another via the shaft-like portion (204). The first direction of extent (A) and the second direction of extent (B) form an angle ϕ of 60° and 120° in relation to one another.

15 Claims, 3 Drawing Sheets

(56) References Cited

U.S. PATENT DOCUMENTS

| | | | | | |
|---|---|---|---|---|---|
| 2,507,174 | A | * | 5/1950 | Phillips | 66/118 |
| 2,530,851 | A | * | 11/1950 | Biggs | 66/118 |
| 2,539,479 | A | * | 1/1951 | Robertson | 66/1 A |
| 2,601,769 | A | * | 7/1952 | Visconti | 66/118 |
| 2,695,506 | A | * | 11/1954 | Kohlmann | 66/117 |
| 3,280,595 | A | * | 10/1966 | Linstead | 66/117 |
| 5,720,187 | A | * | 2/1998 | Matuo | 66/117 |
| 8,499,586 | B1 | * | 8/2013 | Adam | 66/118 |

* cited by examiner

KNITTING NEEDLE

The instant application should be granted the priority dates of 11 May 2012 and 16 Sep. 2011, the filing date of the corresponding German applications DE 20 2011 102 677.2, and DE 20 2011 105 722.8, respectively, as well as 11 May 2012, the filing date of the International patent application. PCT/E P2012/002047.

BACKGROUND OF THE INVENTION

The present invention relates to a knitting needle for producing plait-pattern knitware, including a shaft-like portion, a first limb-like portion, which extends in a first direction of extent, an outwardly directed first free end and second limb-like portion, which extends in a second direction of extent, an outwardly directed second end, wherein both limb-like portions are rigidly connected to one another via the shaft portion.

Knitting needles for making plait-like knitware are known from the state of the art, which have in their central region a trough-like depression. The free ends of such knitting needles form an angle of 180° and thereby are formed as a straight line, with the exception of the depression. The depression serves for receiving the knitting during casting off of a row. However, it is disadvantageous that the depression is formed to be too short, so that, in particular, with large knitware, such as pullovers for example, the risk exists of losing the completed knitting accommodated on the needle by slipping off the needle again. The dropped stitches first must again be tediously taken up, in order to continue with the knitting.

Thus, it is an object of the present invention to provide a knitting needle, by means of which the production of plait-like knitware is performed more easily, more quickly and more safely than is possible with commonly known knitting needles.

SUMMARY OF THE INVENTION

This object is solved with a device having the features of claim 1. Advantageous embodiments and further developments are the subject matter of the dependent claims.

The central idea of the present invention is that the first direction of extent and the second direction of extent form an angle to one another of between 60° and 120°. This is advantageous since in this manner, at least one limb-like portion, depending on the direction of extent, serves to receive and hold the completed knitting. Thus, it is ensured in an advantageous manner that all knitted, retained stitches can be retained. By the angle orientation of the two directions of extent as well as the limb-like portions to one another, the knitting stitches accommodated and held can be fixed and held without sliding. This saves time and improves the knitting quality, since dropped stitches cause positioning errors in the knitware. In the present invention, the direction of extent of the respective limb-like portion relates to its longitudinal direction.

In a further advantageous embodiment, the angle has a value of 80° to 100°, preferably of 85° to 95°. Most preferably is an angle of approximately 90°. This is advantageous, since in this manner, the stitches that are received are held in the angular range and do not slip from the knitting needle. The angular region corresponds according to the present invention at least partially to the shaft-like portion, whereby advantageously, the center of mass of the knitting needle of the present invention is arranged in the shaft-like portion.

Furthermore, an advantageous embodiment of the present invention is constructed, such that the shaft-like portion, which connects the first limb-like section and the second limb-like section with one another, is formed as curved or bent. Advantageously, this curvature is formed, such that is has an angle between 60° and 120°, which the first direction of extent and the second direction of extent have to one another. This is advantageous, since in this manner, in the region of the shaft-like portion, the stationary stitches received can be held until a complete row is knitted.

With a further advantageous embodiment, the shaft-like portion and/or both of the limb-like portions have a cylindrical cross section, whereby the free ends of both of the limb-like portions are formed to project outwardly in their cross section. Preferably, the free ends are formed as rounded tips. This is advantageous, since receiving stitches is simplified during the knitting process and also tightly knitted stitches can be further knitted. The cylindrical cross section serves for a simple and low-wear knitting procedure during the knitting process. The shaft-like portion and/or both limb-like portions and/or the free ends can be hollow inside, solid, or can be combination thereof. Of course, the cross section of the knitting needle according to the present invention is not limited to round, but can be expanded to further forms. Advantageously, the design takes place, such that the center of mass of the knitting needle according to the present invention is arranged between the limb-like portions, preferably in the shaft-like portion, so that a balancing of the weight of the respective limb-like section is achieved.

It is further contemplated that a region at least of one of the limb-like section is formed as curved or bent inwardly or outwardly with its outwardly directed free end. This is advantageous, since then the yarn can be more easily accomodated and knitted, also with complex plait-like patterns.

Preferably, the cross section of the shaft-like portion and both limb-like sections are formed as round. With this embodiment, the cross section has a value of 0.5 to 33 mm, preferably from 1 to 20 mm, more preferably from 1 to 10 mm, and most preferably, from 2 to 7 mm. The cross section corresponds in this regard to the thickness of the needle.

In addition, an advantageous embodiment of the present invention shows that at least one free end, preferably both free ends, and/or the shaft-like portion and/or the first limb-like portion and/or the second limb-like portion has at least partially a flattened cross section. The cross section, therefore, is not round. Advantageously, such a flattening takes place uniformly in the longitudinal direction of the knitting needle, such that a constant cross section exists in the flattened region. If, in particular, both free ends have a flattened cross section, a simplified accomodation of stitches results, and the knitting process is facilitated. For producing plait-like knitware, at least one free end advantageously has a flattened cross section, which is formed to be in the range of 1 to 4 cm, preferably in the range of 1.5 to 2.5 cm from the end regions of the free ends to the respective limb-like portion.

According to the present invention, the flattened cross section is formed, such that the planar, flat region is arranged on the outer side of the knitting needle according to the present invention. The knitting needle outer side is to be understood in this connection as the region facing away from the knitting needle of the present invention. As the inner region, the region of the knitting needle of the present invention that faces the angle is to be understood. Thus, during the knitting process, the stitches are received advantageously by the curved or bent cross sectional region of the corresponding free end. The flattened cross sections region is arranged to face toward the knitware. The stitches thereby enclose or surround the curved region of the corresponding free end, while the flattened region remains essentially exposed. Thus, during the knitting process, the insertion of a free end of a further knitting needle is facilitated, since a free space is formed between the received stitches and the flattened region, in which the corresponding free end of the further needle can be inserted and thus, the stitches can be more easily knitted, since also with very tightly-knit stitches, an insertion opening remains through the free space.

With a further advantageous embodiment of the present invention, the knitting needle is formed as one piece. This is advantageous, since in this manner, no interruptions, for example, in the form of edges, impair the quality of the knitware.

With a further advantageous embodiment of the present invention, both limb-like portions with their free ends have essentially the same length and each has a length of 5 cm to 25 cm and particular preferably, a length of 5 cm to 10 cm, and most preferably, of 8 cm. This is advantageous, since then, the limb-like portions are alternately formed for receiving the stitches. Thus, the additional step of reversing the needle is eliminated. The received stitches stay in the shaft-like portion based on the center of mass of the inventive knitting needle arranged within the shaft-like portion and the resulting balancing-out of the knitting needle according to the present invention.

In a further advantageous embodiment, the center of mass of the knitting needle of the present invention is arranged within the shaft-like portion. This is advantageous, since then, the knitting needle of the present invention is balanced and both limb-like portions are at equilibrium. This prevents a sliding off of the received, stationary stitches from the shaft-like portion. The center of mass is, in the simplest embodiment, arranged in the region of the maximum curving of the shaft-like portion, since in this manner, both limb-like sections are materially independent from one another or can also have different lengths or cross sections, and thus, a material independence and/or a length independence from one another is achieved.

In the simplest case, the shaft-like portion has a continuous cross section, for example round or oval. In addition, however, it is contemplated that the shaft-like portion has two or more cross sections that different from one another and thereby represents the transition region from a thin, first limb-formed section to a second, thick limb-like portion.

In a further, advantageous embodiment of the invention, the shaft-like portion and/or the limb-like portions are formed to be wavy or crimped. Wavy or crimped is to be understood as undulating or rolling, so that at least a curve forming a maximum or minimum is provided. Thus, a limb-like portion according to the present invention is formed in its longitudinal direction as linear and straight-lined in the simplest case. For large knitware, such as pullovers for example, it is therefore advantageous that at least one limb-like portion, preferably both limb-like portions, are formed to be wavy or undulating and in their course in the longitudinal direction, respectively, have a maximum of up to 10 and correspondingly, plus or minus a minimum. So, for example, it is contemplated that the course is formed at least of one of the limb-like sections is formed in the shape of a sinus or cosine curve. Of course, the structure is not limited to these shapes, but also can have markedly different maximums and minimums. Preferably, the maximum or the minimum is perpendicular to the longitudinal axis of the at least one limb-like portion, but also can be formed as twisted about this. The undulated or crimped structure of the at least one limb-like portion is advantageous, since in this manner, a further, additional number of stitches can be received and can be held stationary, without the stitches sliding off of the needle according to the present invention during the knitting motion. The maximum and minimum provided as undulations thus form, respectively, holding devices for the stitches that are received thereon.

With a further advantageous embodiment, the shaft-like portion and/or at least one of the two limb-like portions, preferably both, and/or their respective ends, are made of a natural and/or synthetic material.

Preferably, the materials are selected from the group consisting of wood, horn, metal, in particular aluminum, plastic, bamboo, composites, and/or a combination thereof. This is advantageous, since the inventive knitting needle is useable universally and is not limited depending on the material to be knit.

According to the present invention, the first limb-like portion as well as the second limb-like portion have the same weight. This is advantageous, since in this manner the inventive knitting needle is balanced and the stitches received thereon do not slide off.

BRIEF DESCRIPTION OF THE DRAWINGS

Further advantageous embodiments are provided in the accompanying drawings.

In the drawings.

DETAILED DESCRIPTION OF THE PREFERRED EMBODIMENTS

Figure 1:
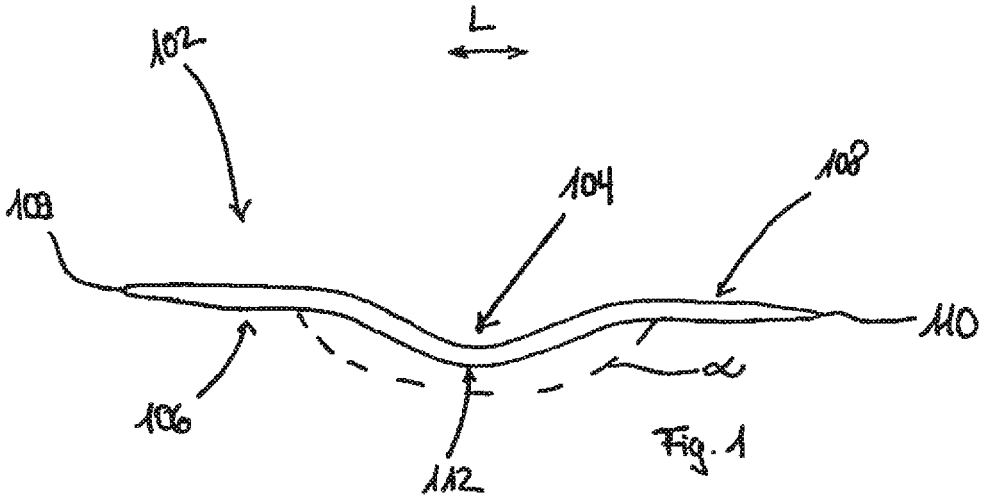
FIG. 1 shows a knitting needle known from the state of the art.

FIG. 1 shows a schematic representation of a common knitting needle 102 for producing plait-like knitware. The knitting needle 102 has a shaft-like portion 104, which connects a first limb-like section 106 and a second limb-like portion 108 with one another. The free ends 109 and 110 form an angle $\alpha$ to one another of approximately 180°. The knitting needle 102 is formed linearly in its longitudinal direction L.

The shaft-like portion 104 is formed as trough-like and has in the image plane a depression 112 formed from below. By means of the flat curving or bending of the shaft-like portion 104, knitting received by the knitting needle 102 can slide off of it, since no sufficient holding function is provided.

Figure 2:
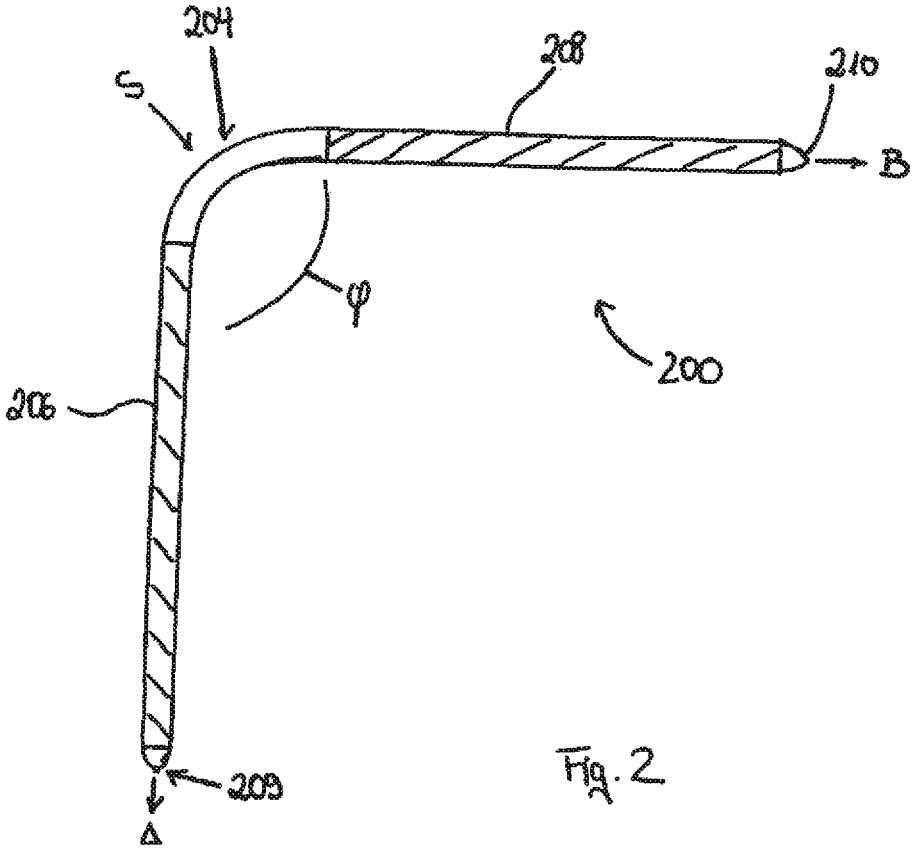
FIG. 2 shows an embodiment of a knitting needle according to the present invention.

FIG. 2 shows a knitting needle 200 in its simplest embodiment. The shaft-like region 204 is formed as curved or bent. Both limb-like portions 206, 208 that are adjacent thereto have a round cross section, like the shaft-like portion 204. In addition, it is also contemplated that the cross section can be formed in a shape other than round, for example, ellipsoidal. The first limb-like portion 206 extends in a direction of extent A and runs to its free end 209 to a tip or point. Advantageously, the resulting tip 208 is rounded, in order to avoid risk of injury during knitting. The second limb-like section 208 extends in its direction of extent B and runs at its free end 210 to a tip or point. Advantageously, the resulting tip is rounded, in order to avoid the risk of injury during knitting. First and second directions of extent A and B form an angle α relative to one another, which is essentially 90°.

If in the knitting process, for example, stitches are received with the first free end, then these glide over the first limb-like portion 206 to the shaft-like portion 204 and are held there by the second limb-like section 208 from sliding off. Thus, no stitches are lost by slipping or sliding off according to the present invention. In the region of the shaft-like portion 204, the center of mass S of the knitting needle 200 according to the present invention is arranged, so that a balancing takes place, such that the first limb-like portion 206 and the second limb-like portion 208 are balanced, based on the center of mass S. In the simplest embodiment, the center of mass S is arranged in the curved region, most preferably in the region of the maximum curving of the shaft-like portion 205. Further, however, it is also contemplated to arranged the center of mass S within the shaft-like portion 204 as desired, for example, more in the direction of extent A of the first limb-like portion 206.

Figure 3:
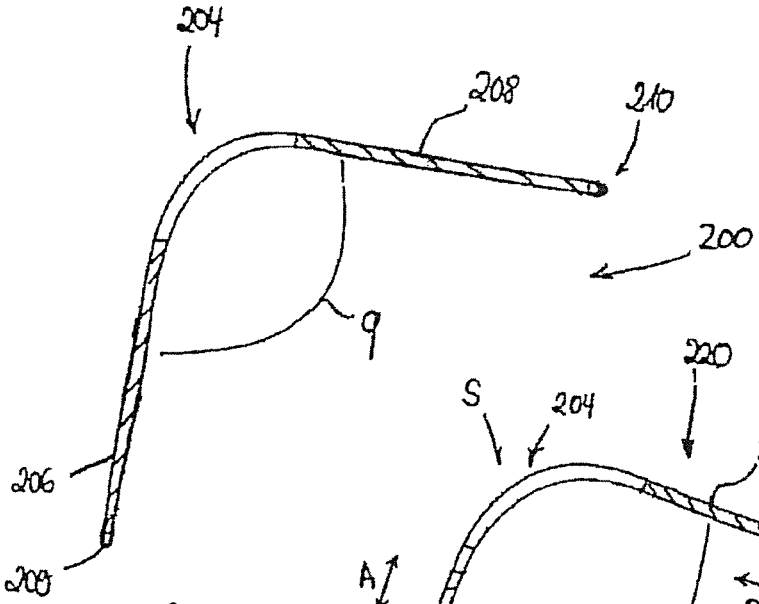
FIG. 3 shows a further embodiment of a knitting needle according to the present invention.

In FIG. 3, a further embodiment of the knitting needle 200 is shown. The same reference numerals as used in the above-described figures are not explained again. The difference to the inventive knitting needle 200 of FIG. 2 shows in this embodiment a different design of the free ends 209 and 210. Here, these do not run to a point, but instead are formed as rounded. This is advantageous, in particular, when thicker yarns are knitted, in order to avoid splitting these with the needle tip during knitting.

Figure 4:
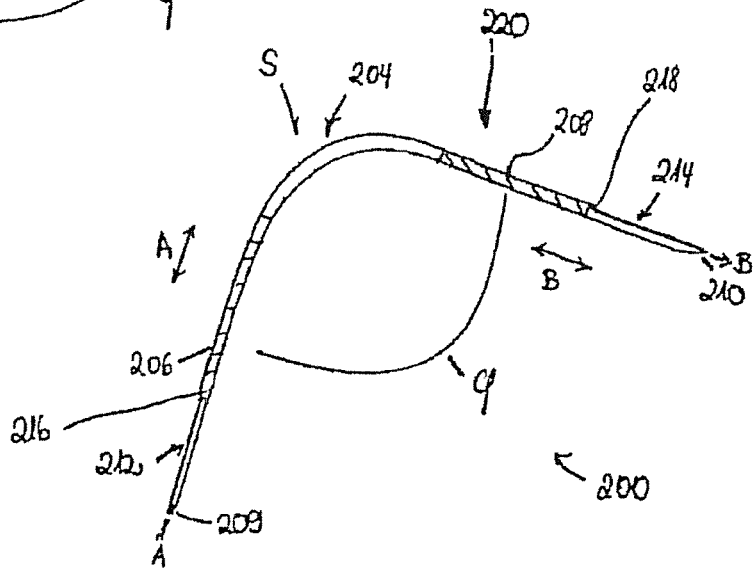
FIG. 4 shows a further embodiment of a knitting needle according to the present invention.

FIG. 4 shows a further embodiment of the inventive knitting needle 200. The same reference numerals as above are mentioned but are not explained again. Both cylindrical limb-like portions 206, 208 are formed as shorted in their respective directions of extent A, B. In the direction of extent A, a region 212 having a flattened cross section connects o the first limb-like portion 206, the region 212 being permanently connected via a stepped element 216 with the first limb-like section 206. In the direction of extent B, a region 214 that has a flattened cross section connects to the second limb-like section, the region 214 being permanently connected via a stepped element 218 with the second limb-like portion 208. Advantageously, the stepped element 216, 218 is formed as rounded, so that the stitches can glide from the free ends 209, 210 onto the limb-like portion 206 or 208 during the knitting process, without having to slow down. This is advantageous, since in this manner, a consistent knitting quality is achieved during the knitting process. Preferably, the free ends 209 and 210 in this case are formed as points or tips and likewise have a flattened cross section. Preferably, the flattened regions 212 and 214 are formed in their longitudinal direction in the range of 1 cm to 4 cm and preferably, from 1.5 to 2.5 cm. According to the application, both flattened regions 212, 214 can have the same lengths in their longitudinal direction or also can be formed differently from one another. Advantageously, the lengths of the flattened regions 212, 214 are selected such that the balancing takes place via the center of mass D in the shaft-like portion.

In addition, also only one flattened region can be provided with the knitting needle 200 according to the present invention. Advantageously, the flattened regions 212 or 214, are arranged, respectively, between a free end 209 or 210 and between a limb-like portion 206 or 208, but of course, are not limited to this arrangement. Thus, it is contemplated that the entire knitting needle 200 according to the present invention has a flattened cross section and thus differs from a round shape. Likewise, it is also advantageous if the flattened region 212 or 214 is formed as rounded on its circumferential edges. This is advantageous since the yarn experiences no friction during the knitting process and is consistent in its quality.

With the knitting process, it is also advantageous if the flattened regions 212, 214 are formed on the knitting needle outer side 220 facing away from the angle ϕ. This is advantageous, since the stitches during the knitting process are taken up with the round circumferential region of the respective free end 209 or 210 and a free space through the flattened cross section is formed between the knitware and free ends 209, 210. The free ends 209, 210 are insertable into the free space in a simple manner and thereby facilitate receiving and knitting of new stitches. Thus, the received stitches have a common contact surface with the round circumferential region.

Figure 5:
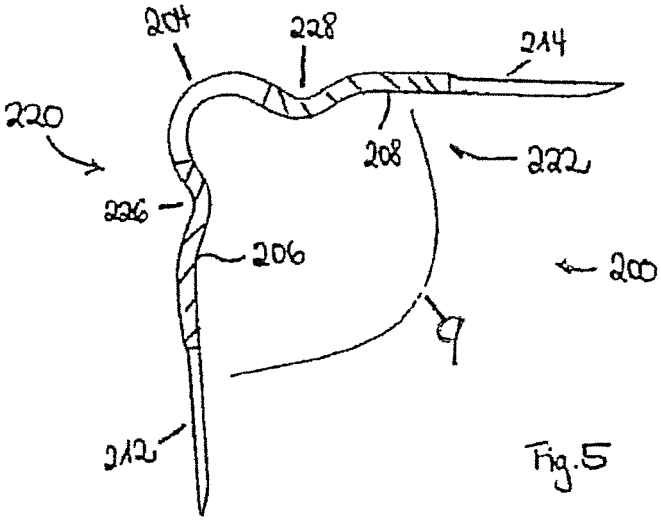
FIG. 5 shows a further embodiment of a knitting needle according to the present invention.

In FIG. 5, a further knitting needle 200 according to the present invention is shown. The shaft-like portion 204 here is formed as curved or bent. The illustrated knitting needle has flattened regions 212 and 214 as well as pointed, free ends 209, 210. The limb-like portions 206, 208 are formed as undulating. Undulating is to be understood in this context as wavy. Both limb-like portions 206, 208 are not formed as straight-lined in their directions of extent A, B, but have, for example, respectively a convex curvature 226, 228 extending to the knitting needle inner side 222, the convex curvature 226, 228 forming a minimum. Depending on the application, the curvatures 226, 228 can be formed more or less strongly.

Further, it is contemplated that the curvatures 226, 228 can be formed as concave, convex, or a combination thereof. For example, the first curvature 226 can be formed as convex and the second curvature 228 can be formed as concave.

Of course, this is the simplest example. The knitting needle 200 according to the present invention is not limited thereto, but can also have more such curvatures 226, 228, preferably between one and 10 curvatures, which are arranged asymmetrically and furthermore, can be formed to be markedly different from one another. The curvatures 226, 228, according to the design, are to be understood as minimum or maximum.

Figure 6:
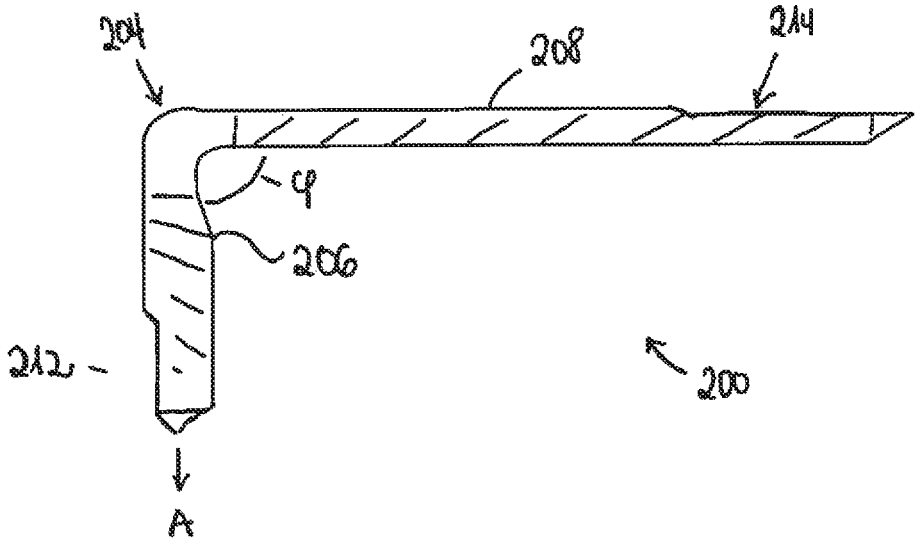
FIG. 6 shows a further embodiment of a knitting needle according to the present invention.

FIG. 6 shows a further embodiment of a knitting needle 200 according to the present invention. First and second limb-like portions 206 and 208 have a comparable weight. The first limb-like section 206 is shortened in its direction of extension A compared to the second limb-like section 208 and has an enlarged cross section. Advantageously, the shaft-like portion 204 has essentially the same cross section as the second limb-like portion 208 and widens in its cross section first with transition in the first limb-like portion 206, whereby such a widening is formed advantageously as funnel-shaped. The angle ϕ here is approximately 90°. In addition, it is also contemplated that the shaft-like portion 204 itself has a different cross section, so that the transition from a thin, second limb-like portion 208 occurs in a thicker, first limb-like portion 206 within the shaft-like portion 204 and vise versa. Advantageously, the design of the limb-like portions 206, 208 as well as the shaft-like portion 204, takes place such that the center of mass S of the knitting needle 200 of the present invention preferably is arranged within the shaft-like portion 204, so that both limb-like portions 206, 208 are arranged to be balanced, in order to prevent the stitches accommodated thereon from sliding off.

For balancing the knitting needle 200 of the present invention in the shaft-like region 204, it is contemplated to make both limb-like portions 206, 208 from different materials with different net weights. Thus, material combinations, for example, of bamboo/plastic of plastic/metal are contemplated. Such a knitting needle 200 according to the present invention is advantageous, since different yarn strengths can be knitted with only one inventive knitting needle 200. In addition, it is also contemplated with limb-like portions 206, 208 having the same lengths that these likewise are made from different materials.

Preferably, the knitting needle 200 of the present invention is to be understood as a plait-pattern needle, which is suitable by its form to easily and quickly knit plait- or braided patterns, without causing stationary stitches that are in place on the needle to slide off or errors in positioning.

According to the present invention, the knitting needle 200 has a total length of 10 to 45 cm, preferably, 14 to 18 cm, and most preferably, of 16 cm.

Figure 7:
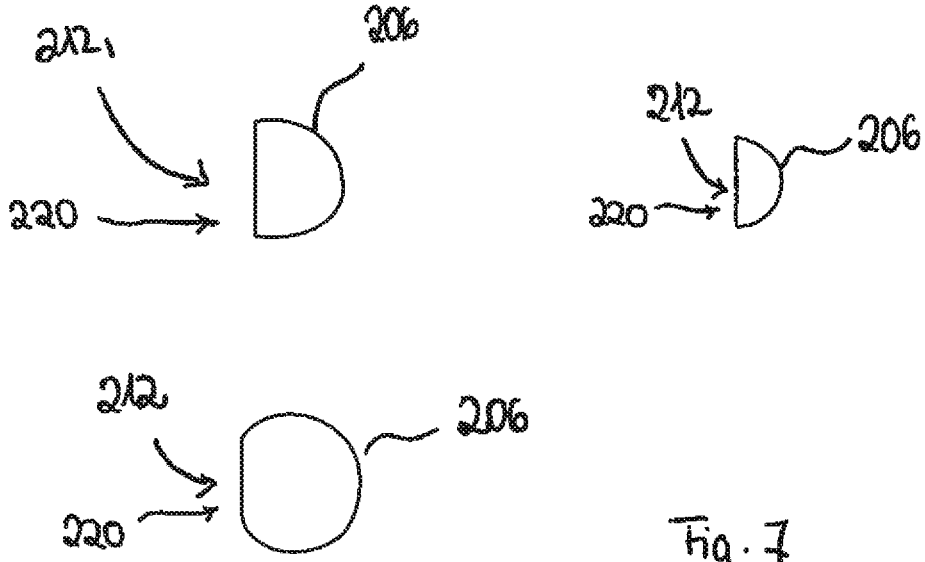
FIG. 7 shows as a schematic example for a flattened cross-sectional region of a knitting needle according to the present invention.

In FIG. 7, for a clarifying example, flattened regions 212 according to the present invention are shown. These, of course, are arranged transferably on the flattened region 214 and not limited to the illustrated example, but can be broadened in any manner. According to the application, the flattened regions 212, 214 can be formed more or less strongly.

The Applicant reserves rights to claim all of the features disclosed in the instant application as important to the present invention, as far as they are novel individually or in combination with regard to the state of the art.

The specification incorporates by reference the disclosure of German patent applications DE 20 2011 102 677.2 and DE 20 2011 105 722.8, filed 11 May 2012 and 16 Sep. 2011, respectively, as well as International application PCT/EP2012/002047, filed 11 May 2012.

The present invention is, of course, in no way restricted to the specific disclosure of the specification and drawings, but also encompasses any modifications within the scope of the appended claims.

Reference Numeral List

102 knitting needle according to the state of the art
104 shaft-like portion
106 first limb-like portion
108 second limb-like portion
109 first free end
110 second free end
112 depression
200 knitting needle according to the present invention
204 shaft portion
206 first limb-like portion
208 second limb-like portion
209 first free end
210 second free end
212 first flattened region
214 second flattened region
216 first stepped element
218 second stepped element
220 needle outer side
222 needle inner side
226 curvature
228 further curvature
L longitudinal direction
A first direction of extent
B second direction of extent
$\alpha$ angle
$\phi$ further angle

The invention claimed is:

1. A cable needle (200) for producing plait-pattern knitware, comprising:

a shaft portion (204);

a first limb (206), which extends in a first direction of extent (A) and has a first outwardly directed free end (209); and a second limb portion (208), which extends in a second direction of extension (B) and has a second outwardly directed free end (210);

wherein said first and second limb portions (106; 208) are rigidly connected to one another via the shaft portion (204), wherein said first and second outwardly directed free ends (209, 210) are each configured to receive stitches of the knitware, wherein the first direction of extent (A) and the second direction of extent (B) form an angle $\phi$ relative to one another that lies in a range of 60° to 120° , and wherein a center of gravity is disposed within the shaft portion (204).

2. The cable needle according to claim 1, wherein the angle $\phi$ is 80° to 100°.

3. The cable needle according to claim 1, wherein the angle $\phi$ is 85° to 95°.

4. The cable needle according to claim 1, wherein the shaft portion (204) is curved.

5. The cable needle according to claim 1, wherein the shaft portion (204) and/or both limb portions (206; 208) have a cylindrical cross section, wherein the free ends (209; 210) are formed to taper outwardly in their cross sections.

6. The cable needle according to claim 1, wherein at least one of said first and second free ends (209; 210), and/or the shaft portion (204) and/or the first limb portion (206) and/or the second limb portion (208) have at least partially a flattened cross section.

7. The cable needle according to claim 1, wherein the cable needle is formed as one piece.

8. The cable needle according to claim 1, wherein the first and second limb portions (206; 208) with their respective free ends (209; 210) are substantially the same length and have a length of 5 cm to 25 cm.

9. The cable needle according to claim 1, wherein the first and second limb portions (206; 208) have a length of 5 cm to 10 cm.

10. The cable needle according to claim 1, wherein the first and second limb sections (206, 208) have a length of 8 cm.

11. The cable needle according to claim 1, wherein the shaft portion (204) and/or the limb portions (206; 208) are crimped.

12. The cable needle according to claim 1, wherein the shaft portion (206) and/or at least one of the two limb portions (206; 208), and/or their respective ends (209; 210) comprise natural and/or synthetic materials.

13. The cable needle according to claim 12, wherein the materials are selected from the group consisting of wood, horn, metal, in particular, aluminum, plastic, bamboo, composite materials, and/or a combination thereof.

14. The cable needle according to claim 6, wherein both free ends (209, 210) have at least partially a flattened cross section.

15. The cable needle according to claim 12, wherein both limb portions (206; 208) and/or their respective ends (209; 210) comprise natural and/or synthetic materials.

* * * * *